US006543207B2

(12) United States Patent
Mainquist et al.

(10) Patent No.: US 6,543,207 B2
(45) Date of Patent: Apr. 8, 2003

(54) SELECTIVELY VENTING AND LOAD-SEALING CLOSURE

(75) Inventors: W. Keith Mainquist, Pleasanton, CA (US); John F. Breznock, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 09/732,119

(22) Filed: Dec. 6, 2000

(65) Prior Publication Data

US 2002/0066716 A1 Jun. 6, 2002

(51) Int. Cl.[7] ..... B65B 31/04
(52) U.S. Cl. ..... 53/447; 53/489
(58) Field of Search ..... 53/447, 489; 206/386, 206/427; 215/310, 311; 220/203.04, 203.11, 203.16, 203.17, 203.18

(56) References Cited

U.S. PATENT DOCUMENTS 2,173,571 A 9/1939 Jesnig et al.
2,620,938 A * 12/1952 Jesnig ..... 215/254
3,410,436 A * 11/1968 Foss et al. ..... 215/249
3,473,654 A * 10/1969 Zimmerman ..... 206/427
4,690,281 A * 9/1987 Berthet ..... 206/386
4,773,572 A * 9/1988 Stull ..... 222/521
5,035,323 A * 7/1991 Daniels et al. ..... 206/386
5,758,474 A * 6/1998 Ziegler ..... 53/153

* cited by examiner

*Primary Examiner*—Scott A. Smith
*Assistant Examiner*—Nathaniel Chukwurah
(74) *Attorney, Agent, or Firm*—DiPinto & Shimokaji, PC

(57) ABSTRACT

A vented closure, for preventing deformation of a container containing a gas evolving liquid, is provided. The closure includes a first closure member and a second closure member. The first closure member seals the container from the outside atmosphere and defines a gas inlet, a gas outlet and a gas flow passage between the inlet and the outlet. A gas-permeable, liquid-impermeable membrane is placed in the gas flow passage. The second closure member is moveably fitted on the first closure member and encases the first closure member with a small clearance fit that allows gas passage. A sealing element coupled to the second closure member is aligned with the gas outlet of the first member so as to block gas flow when a predetermined load is applied to the second closure member and allow gas flow when the predetermined load is absent.

16 Claims, 8 Drawing Sheets

SELECTIVELY VENTING AND LOAD-SEALING CLOSURE

BACKGROUND OF THE INVENTION

1. Field of the Invention

The present invention generally relates to container closures and, more particularly, to container closures having venting capability.

2. Description of the Related Art

Products such as hypochlorite bleach often generate gases. A major problem arises when containers containing such products are packaged, transported, and stored on store shelves. As the product evolves gases, the internal pressure of the container increases excessively and leads to various types of container failures such as bottle bulging and stress cracking. Certain other chemical products, however, may cause containers to collapse by reacting with air in the headspace and thereby reducing the internal pressure. Elevation changes during the transportation of the bottled products can also lead to an increase or decrease in the internal pressure of the containers relative to ambient pressure and cause similar effects.

One prior art way of avoiding such bottle failures has been the use of vented closures so that bulging or collapse of the containers can be precluded. In such applications, the container caps are provided with gas permeable seals or liners to permit excessive internal pressure to vent out to the atmosphere, while retaining the associated liquid within the container. As such, the release of excessive pressure is intended to prevent the aforementioned failure problems.

However, it is customary and economical during storage and transportation for the lower cases of bottles to share the load with the corrugated case in supporting the weight of cases stacked above the lower ones. Such stacks are supported, in part, by virtue of the internal pressure of the containers located in the lower level cases. A case of bottles with vented closures, however, is very ineffective in supporting additional weight because they cannot establish internal pressure and, thus, there is more cost due to the need for sturdier boxes, compared to bottles that are gas-sealed. This is because under load a sealed bottle builds up significant internal pressure (e.g., about 4–5 psig) and it is this pressure that enables the bottle to support a much greater top-load. In such a scenario, the bottle is prevented from bulging at the bottom by virtue of being compressed between two surfaces, namely, the cases above and the cases beneath. When the load is removed the bottle pressure returns to what it was before being loaded. Thus, a gas-sealed bottle is highly desirable for case stacking-strength whereas a gas-vented bottle is highly desirable when not loaded, as on a store shelf.

In view of the foregoing, there is a need for alternative container closure systems that allow venting of the containers while allowing load sharing by precluding venting when the container cases are stacked.

SUMMARY OF THE INVENTION

The present invention provides a bottle closure that seals a bottle, which contains a gas evolving liquid such as hypochlorite bleach, when a top load is applied on the closure but vents the container when the top load is absent.

Specifically, the closure of the present invention utilizes the weight of filled cases that are located at the upper levels of a case stack to seal the bottles in the cases located at the lower levels of the stack. When a load of top level cases is directed down on the bottles having the inventive closure, the closure prevents gas from escaping from the bottle through the closure and builds up internal pressure that enables the bottle to support the top load without having any container failure. In conjunction with the internal pressure created by the closure, this configuration prevents containers from bulging at the bottom by virtue of compressing each case between its upper and lower surfaces.

In one aspect of the present invention, a vented closure for preventing deformation of a container containing a gas evolving liquid comprises a first closure member and a second closure member. The first closure member seals the container from the outside atmosphere and defines a gas inlet, a gas outlet, and a gas flow passage between the inlet and the outlet. A gas permeable membrane covers the gas flow passage. The second closure member is moveably fitted on the first closure member and encases the first closure member with a small clearance fit that allows gas passage. A sealing element is coupled to the second closure member and is aligned with the gas outlet of the first member so as to block gas flow when a predetermined load is applied to the second closure member and allows the flow of gas when the predetermined load is removed.

In another aspect of the present invention, a method of transporting containers having a gas evolving liquid comprises placing a vented closure on at least one of the containers, the vented closure being in a reference position or a sealing position relative to the at least one container wherein the reference position allows gas venting from the at least one container and the sealing position prevents gas venting from the at least one container. The containers are positioned in a stacked relationship, and a load is produced on the vented closure to place the vented closure in the sealing position.

These and other features, aspects and advantages of the present invention will become better understood with reference to the following drawings, description and claims.

DETAILED DESCRIPTION OF THE INVENTION

As will be described below, the present invention is a closure that seals a container, which contains a gas evolving liquid such as hypochlorite bleach, when a top load is applied on the closure but vents the container when the top load is absent. During storage and transportation of the products, containers are conventionally packaged and restrained in container cases which are further stacked as case stacks. Each such case contains at least one, and preferably, more than one container. Each case stack may have a predetermined number of container cases, having a predetermined weight, which are placed on top of one another. In such stacks, the lower the level of the case then the more weight that case should withstand. Thus, from a top case to a bottom case in an axial direction, cases forming a case stack carry a gradually increasing top load or weight and thereby form a stack load over the lower level cases of the case stack.

In a preferred embodiment, the closure of the present invention utilizes the weight of container cases, that are located at the upper levels of the stack, to create a vapor seal in the containers in the cases located at the lower levels of the stack. When the top load is directed down on the containers having the inventive closure, the closure prevents gas from escaping from the container through the closure and builds up an internal pressure that enables the container to support a top load without having any container failure. In this respect, and except for the uppermost case, each case and hence the containers in them is confined or sandwiched between two cases while the lowermost case is supported by a base or floor at the bottom and a case above. In conjunction with the internal pressure created by the closure, this configuration prevents containers from bulging at the bottom by virtue of compressing each case between its upper and lower surfaces.

However, when no load is directed down on the closure, for example when the cases are removed from the stacks and stored individually on a store shelf, the closure of the present invention allows gas from inside the container to flow out of the container and thereby reduce the internal pressure that may cause bulging in the absence of stack load.

Figure 1:
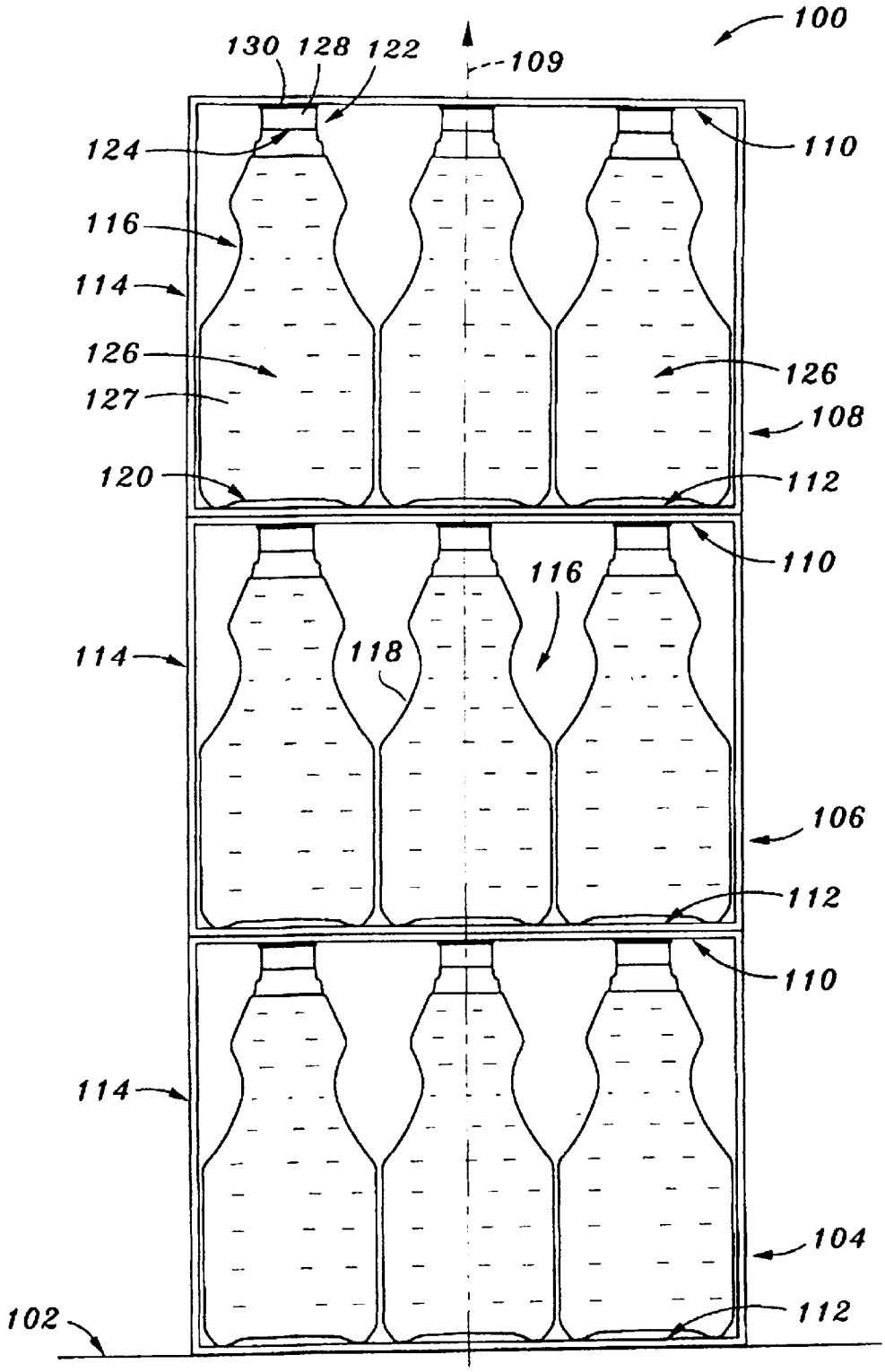
FIG. 1 is a schematic view of a case stack of the present invention.

Reference will now be made to the drawings wherein like numerals refer to like parts throughout. FIG. 1 shows an exemplary case stack 100 which is formed on a base 102 such as a pallet or warehouse floor or a similar flat surface. In this embodiment, the stack 100 may comprise a number of container cases 104, 106 and 108 stacked upon each other along a vertical axis 109 as in the manner shown in FIG. 1. Although it is exemplified with three cases, the stack 100 may have another predetermined number of cases. In this embodiment, each case 104–108 is preferably shaped as a rectangular prism or cube comprising a top wall 110, a bottom wall 112, and side-walls 114. The top and bottom walls 110 and 112 are configured to be perpendicular to the axis 109 while the side-walls 114 are substantially parallel to the axis 109. The container cases may preferably be made of corrugated cardboard.

Referring to FIG. 1, packaged in each case 104–108 and in an orderly fashion are a number of containers 116 or bottles placed on the bottom wall 112 of the cases 104–108. The bottle 116 may comprise a body portion 118 having a bottom 120 and a neck 122 or finish portion. The finish portion 122 includes an opening 124 to dispense liquids from or fill liquids into an interior 126 of the bottle 116. The interior 126 of the bottle 116 is filled with a gas evolving chemical product 127 or solution such as hypochlorite bleach. Due to its chemical nature, hypochlorite bleach continuously produces a gas containing mainly oxygen that increases the internal pressure of the bottle 116, if the bottle 116 is sealed. Although the invention is described using hypochlorite bleach as a gas evolving product, this invention may be used with the chemicals used in the automotive industry, chemical industry, insecticides, home cleaning products, laundry products, swimming pool cleaning products, products requiring child-resistant closures, and the like.

In the preferred embodiment, a vented closure 128 of the present invention is secured to the finish 122 of the bottle 116. As will be described more fully below, the vented closure 128 is capable of reducing the internal pressure exerted by the evolving gases by venting the interior 126 of the bottle 116 if there is no load on the closure 128. With the containers packaged, upper surfaces 130 of the vented closures 128 are flush with the top walls 110 of the container cases 104–108. The functionality of this configuration can be exemplified using the cases 106 and 108 in the stack 100. In this respect, when the weight of the case 108 is applied along the vertical axis 109 on the top wall 110 of the case 106, the top wall 110 of the case 106 is supported by the bottles 116 in the case 106. In other words, the load applied by the case 108 is shared by the bottles 116 in the case 106. This support action generated by the load carrying bottles is called load-sharing because the load is shared between the corrugated cases 104–108 and the bottles 116 themselves. As previously mentioned, the effectiveness of the load sharing function is directly related to the internal pressure of the bottle 116 and the closure 128 of the present invention which provides an effective tool to advantageously preserve this pressure and use it for a load sharing function. In this embodiment, internal bottle pressure needed for maintaining top load strength is in the range of about 2 psig to 5 psig. The load necessary to vapor seal is in the range of about 0.5 kilograms to 50 kilograms. Accordingly, a detailed description of a preferred embodiment of the closure 128 will be given in the following section.

Figure 2:
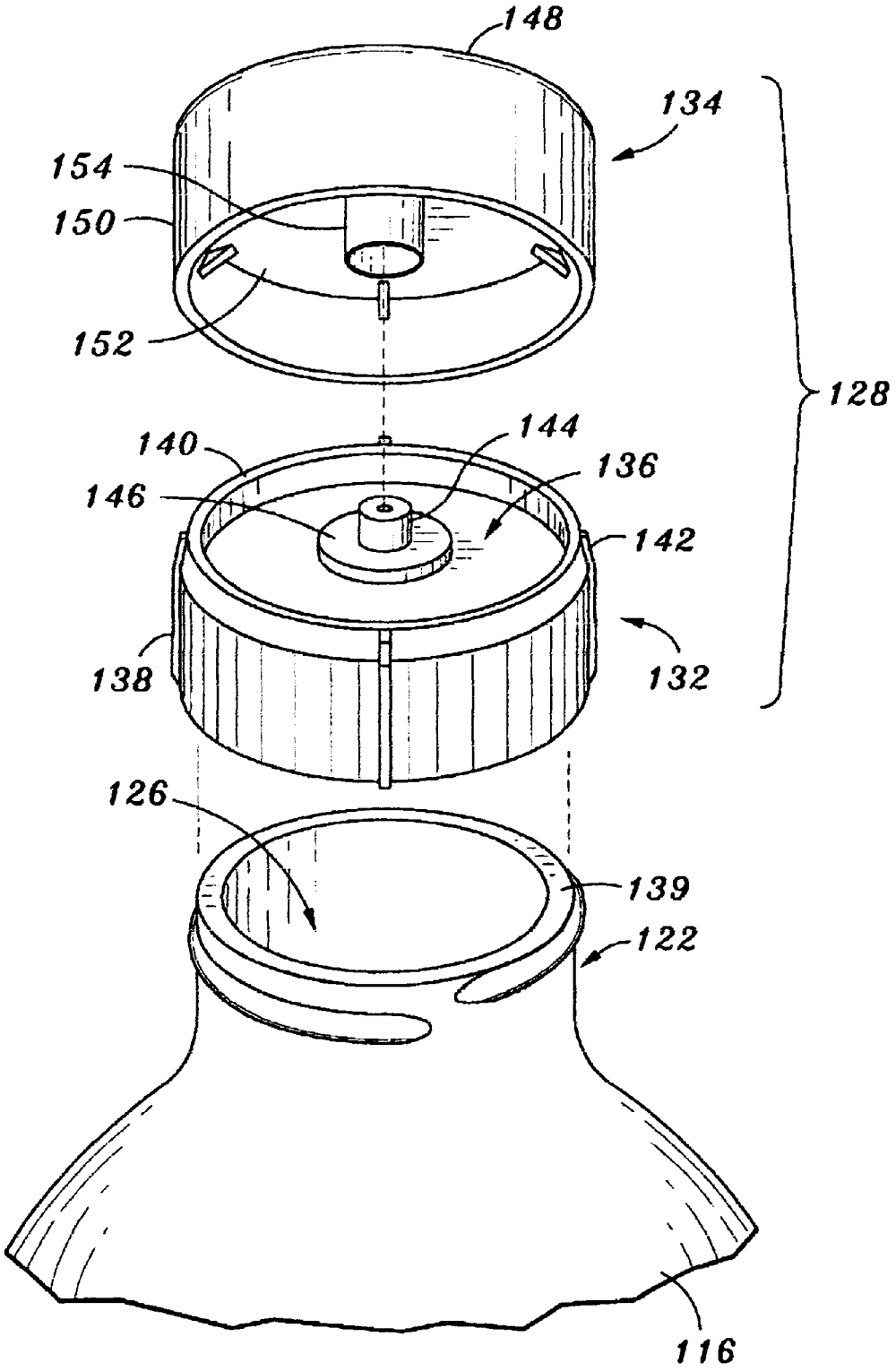
FIG. 2 is a schematic exploded view of a container closure of the present invention.

As shown in FIG. 2, and in accordance with the principles of the present invention, the closure 128 may comprise a first closure member 132 and a second closure member 134. The first closure member 132 is generally comprised of a top surface 136 and a circumferential side wall 138 extending downwardly from the perimeter of the top surface 136. As will be described below, through the circumferential side wall 138, the closure member 128 is secured to the finish 122 of the bottle 116 and on a sealing surface 139 of the finish 122 by screwing the first closure member 132 onto the finish 122. A reduced diameter side wall 140 projects upwardly and perpendicular to the top surface 136. The reduced diameter side wall 140 may be provided with, preferably, four lower tab members 142 radially and 90° apart along an outer perimeter of the reduced diameter side wall 140. A gas port 144 shaped as a cylinder is placed preferably at the center of the top surface 136 and projects perpendicular to the top surface 136. Preferably, a gasket 146, such as an O-ring, is placed around the gas port 144. As will be described below, the gas port 144 is in fluid communication with the interior 126 of the bottle 116 and gas venting occurs through the gas port 144.

Figure 3A:
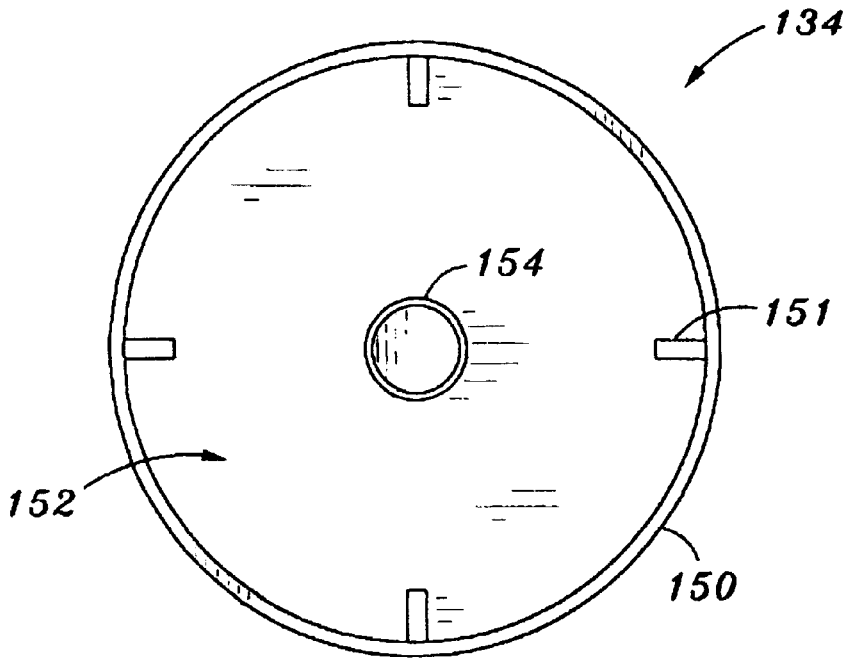
FIG. 3A is a schematic bottom view of a second closure member of the container closure shown in FIG. 2.
Figure 3B:
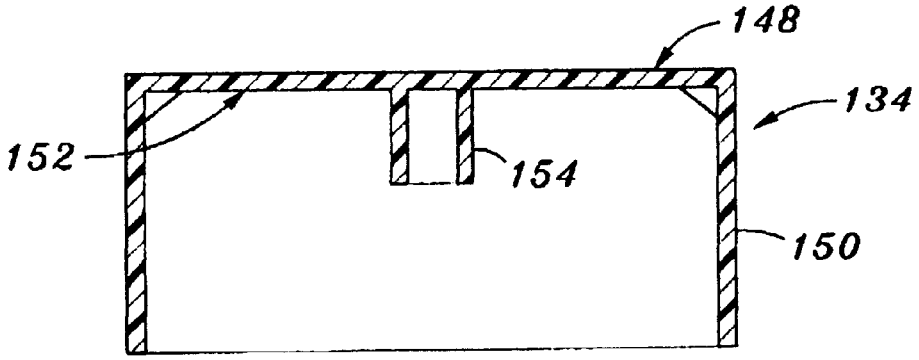
FIG. 3B is a schematic side view of the second closure member shown in FIG. 3A.

In application, the second closure member 134 is loosely fitted on the first closure member 132. The second closure member 134 is comprised of a top panel 148 and a circumferential side wall 150 extending downwardly along the perimeter of the top panel 148. Referring to FIGS. 2–3B, preferably four upper tab members 151 are distributed radially and 90° apart along where the side wall 150 adjoins an inner surface 152 of the top panel 148. In application, during the twist removal of the closure 128 from the finish 122 or twist placement of the closure 128 on the finish 122, the upper tab members 151 and the lower tab members 142 engage each other and allow opening or sealing of the bottle. A sealing element 154 is coupled to the inner surface 152 of the second closure member 134. In this embodiment, the sealing element 154 is shaped as a hollow cylinder and sized to fit over the gas port 144 with a radial clearance allowing gas venting.

Figure 4A:
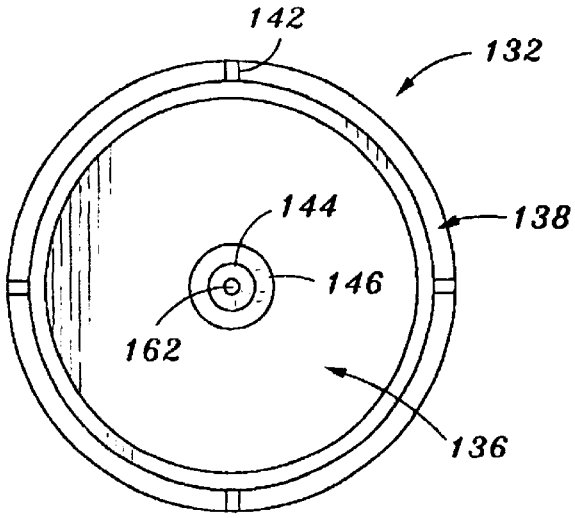
FIG. 4A is a schematic top view of a first closure member of the closure of the present invention.
Figure 4B:
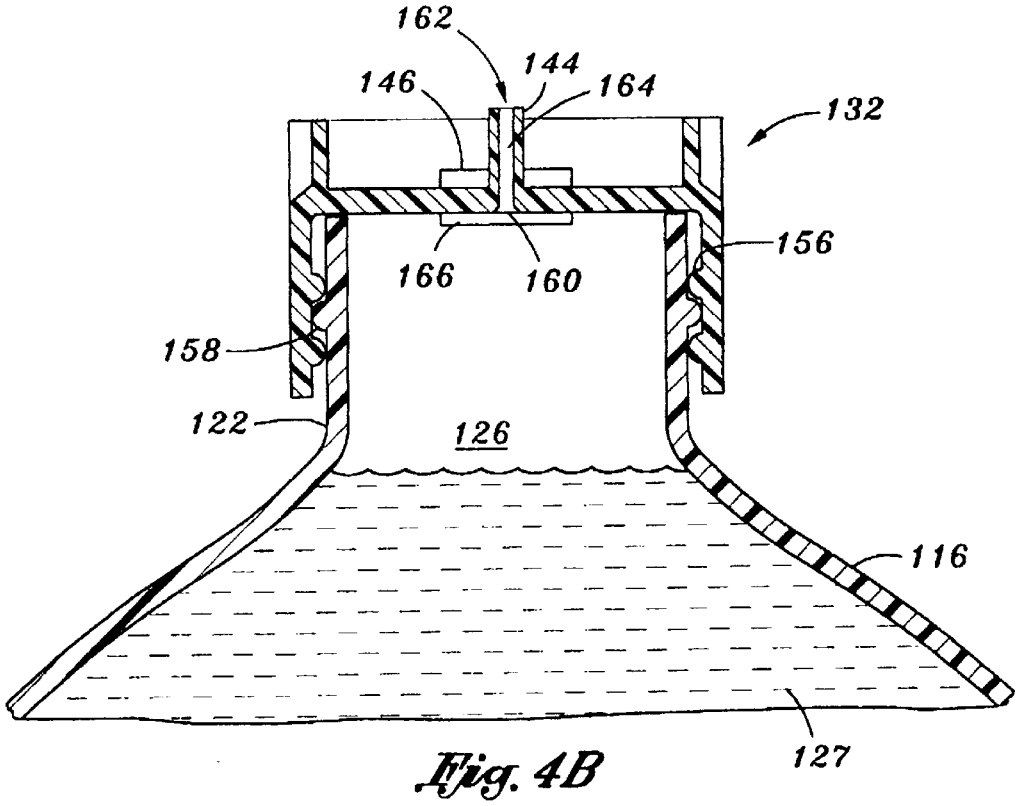
FIG. 4B is a schematic side view of the first closure member shown in FIG. 4A wherein the closure has been secured on a bottle finish.

As shown in FIGS. 4A and 4B, the first closure member 132 is secured on the finish 122 by cooperative relation between threads 156 formed on an inner surface of the wall 138 and threads 158 of the finish 122 of the bottle 116. Referring to FIG. 4B, the gas port 144 is comprised of a gas inlet 160, a gas outlet 162 and a gas flow passage 164 extending between the inlet 160 and the outlet 162. The gas flow passage 164 is in fluid communication with the interior 126 of the bottle and connects the interior 126 to the outside. A gas-permeable, liquid-impermeable membrane 166 covers the gas inlet 160 and prevents liquid from flowing into the gas flow passage 164. The entire closure may be manufactured from polymer materials such as plastics, particularly, thermoplastics. The closure may be sized to have a diameter in the range of about 18–60 mm. The gas flow passage may have a diameter in the range of about 0.5–3.0 mm.

Figure 5A:
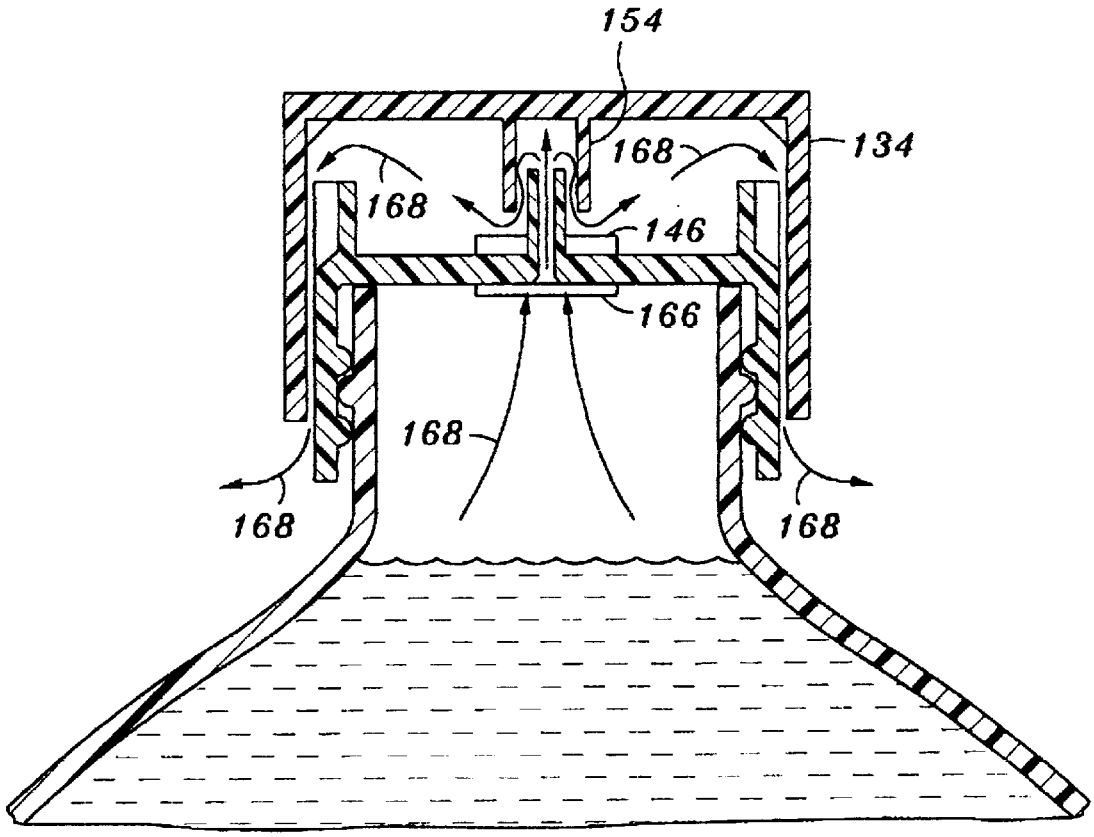
FIG. 5A is a schematic side view of the closure illustrating the manner in which the venting through the closure occurs when no top load is applied.

FIG. 5A shows the operation of the closure 128 when no top load is applied. As shown in FIG. 5A, with no top load, the second closure member 134 is in a reference position and the sealing element 154 is in a relatively elevated position over the gasket 146 thereby allowing gas venting through the gas port 144. The gas venting from the interior of the bottle to the outside environment is depicted by arrows 168.

Figure 5B:
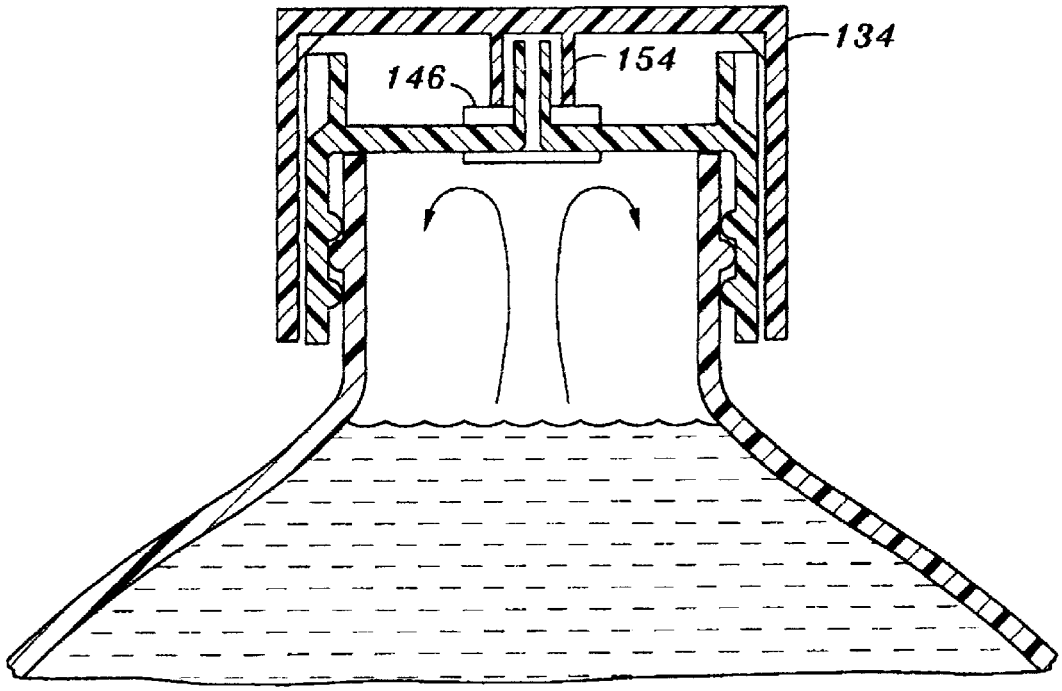
FIG. 5B is a schematic side view of the closure illustrating the manner in which gas sealing of the closure occurs when a top load is applied.

FIG. 5B shows the operation of the closure 128 under load sharing conditions. As shown in FIG. 5B, with the top load, the second closure member 134 moves downward into a sealing position. In this position, the sealing element 154 presses against the gasket 146 and effectively seals the gas port 144 thereby preventing gas venting and allowing internal pressure to build for supporting top load.

Figure 6A:
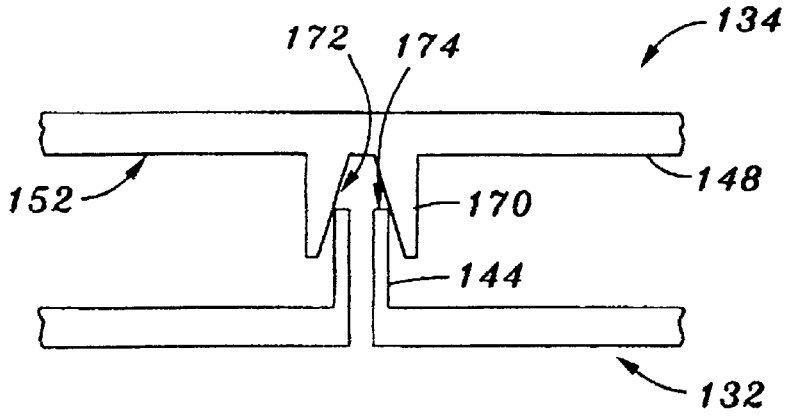
FIGS. 6A to 6C are schematic views of alternative embodiments of sealing elements of the closure.
Figure 6B:
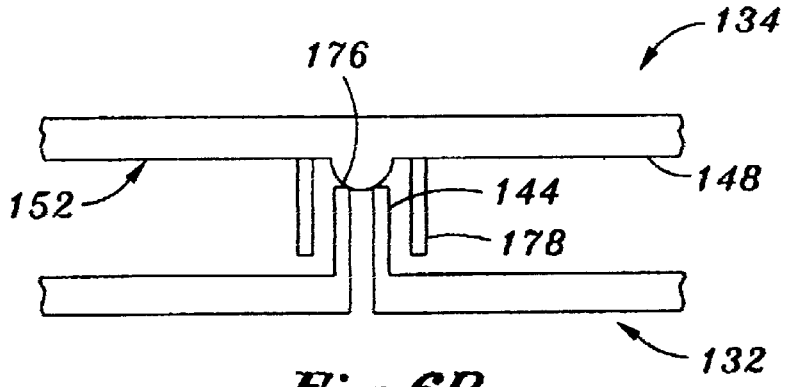
Figure 6C:
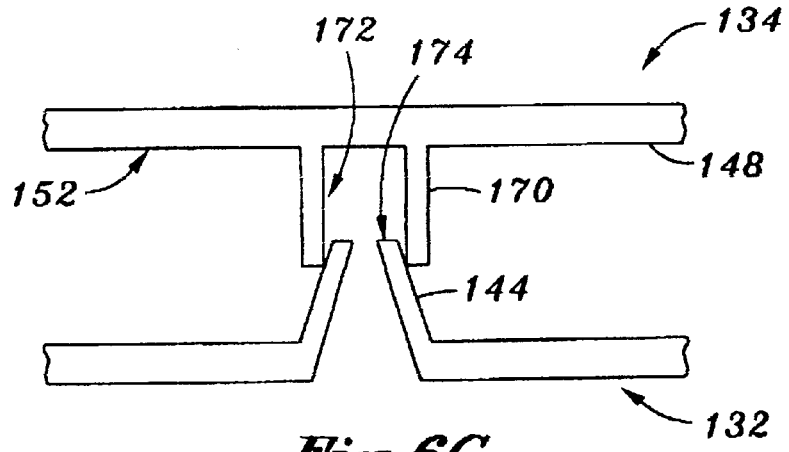

Although in the preferred embodiment the sealing element 154 is generally described as a hollow cylinder fitting over the gas port 144 of the closure 128, the sealing element 154 and/or the gas port 144 may be configured in various alternative shapes and designs. As shown in partial views, in one alternative embodiment (FIG. 6A), a sealing element 170 may have a frusto-conical shape. The sealing element 170 is attached to the inner surface 152 of the top panel 148. When the closure 128 is loaded, an inner surface 172 of the sealing element 170 comes into contact with an upper circumferential edge 174 of the gas port 144 and thereby seals the gas port 144 without needing a gasket. In a second alternative embodiment (FIG. 6B), a protuberance 176 designed into the inner surface 152 of the top panel 148 seals the gas outlet 162 of the gas port 144. This embodiment may use a hollow cylinder 178, which is also attached to the inner surface 152, for alignment purposes. In a third embodiment (FIG. 6C), the sealing element 170 is of a cylindrical shape while the gas port 144 is of a frusto-conical shape such that the upper circumferential edge 174 of the gas port 144 provides a seal with the inner surface 172 of the sealing element 170.

EXAMPLES

It will be understood that this invention is susceptible to modification in order to adapt it to different uses and conditions. The following example is given for illustrative purposes only and is not intended to impose limitations on the subject invention.

Figure 7:
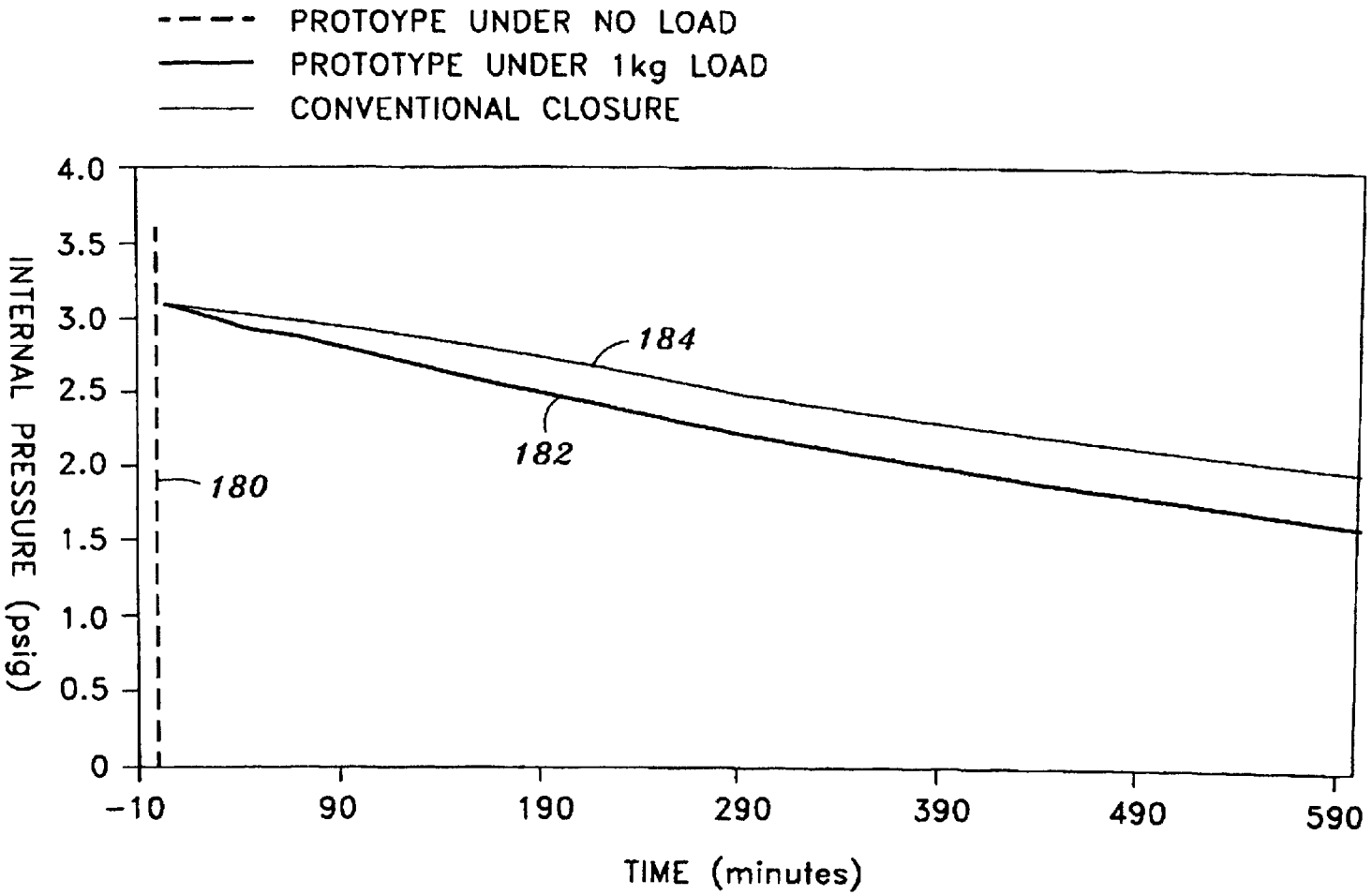
FIG. 7 is a graph comparing the performance of the closure under various conditions.

A stainless steel apparatus or container was constructed for the purpose of testing the sealing and venting properties of the invention. The apparatus contains a threaded port by which a closure can be attached, ports for controlling the internal pressure through use of pressurized air, and a pressure gauge, which is connected to a computer for recording of the results. For a given test, the apparatus is pressurized to roughly 3 psig, and then the internal pressure is monitored over time. Plots 180 and 182 comparing performance of the prototype closure under conditions of no load and a 1 kg load respectively are shown in FIG. 7, and also compared against a conventional closure plot 184.

A convenient measure of the degree of venting, which is obtained from such plots, is the half-life. The half-life is the time required for the internal pressure to drop from its initial pressure of about 3 psig to half that value. Low half-lives, on the order of seconds, are expected for a vented closure, whereas high values, on the order of hours or days, are expected for a sealed closure. When testing the prototype with no load applied to the outer cap, the half-life was found to be about 6 seconds, indicating a venting mode. In contrast, when a 1 kg weight was placed on top of the closure, the half-life was found to be nearly 11 hours, close to that obtained for a regular sealed closure (14 hours). The results clearly demonstrate that the invention functions as intended.

It should be understood, of course, that the foregoing relates to preferred embodiments of the invention and that modifications may be made without departing from the spirit and scope of the invention as set forth in the following claims.

We claim:

1. A method of transporting containers having a gas evolving liquid, comprising:

placing a vented closure on at least one of the containers, the vented closure having a reference position and a sealing position relative to the at least one container, wherein the reference position allows gas venting from the at least one container when no load is placed on the vented closure and the sealing position prevents gas venting from the at least one container when a load is placed on the vented closure, the vented closure being in the reference position in the absence of a load, the vented closure being in the sealing position in the presence of a load, such that the vented closure is responsive to a load irrespective an internal pressure of the at least one of the containers;

positioning the containers in a stacked relationship; and producing the load on the vented closure to place the vented closure in the sealing position; and increasing a load-bearing capacity of the at least one of the containers as a consequence of producing the load on the vented closure.

2. The method of claim 1, further comprising packaging the containers in a plurality of cases.

3. The method of claim 2, further comprising stacking the cases in a stack so as to form a plurality of levels of cases.

4. The method of claim 3, further comprising placing a vented closure on each of the containers.

5. The method of claim 4, further comprising placing the load on at least one of the levels of cases.

6. The method of claim 5, further comprising sharing the load among the containers and at least one case in the at least one of the levels of cases.

7. The method of claim 6, wherein sharing the load comprises preventing the containers from bulging.

8. The method of claim 1 further comprising removing the load on the vented closure to place the vented closure in the reference position.

9. A method of transporting a stack of cases holding containers filled with a gas evolving liquid, the method comprising:

providing a vented closure for the container, the vented closure having an upper surface, The vented closure having a reference position allowing gas to escape from the container without building up pressure therein when no load is placed on the vented closure, the vented closure having a sealing position preventing gas from escaping from the container when a load is placed on the vented closure and thereby maintaining internal pressure when a load is placed on the vented closure, the vented closure being in the reference position in the absence of a load, the vented closure being in the sealing position in the presence of a load, such that the vented closure is responsive to a load irrespective an internal pressure of the container;

placing at least one container having a vented closure into the cases to produce a filled case, the upper surface of each vented closure flush with a top wall of the filled case;

forming the stack by vertically stacking a plurality of filled cases;

receiving a load by the top wall, the load provided by a portion of the stack resting upon the filled case, the load distributed by the top wall to the upper surface of the vented closure of the at least one container within the case, the distributed load placing the vented closure into a sealing position; and maintaining an internal pressure of the at least one of the containers to thereby increase a load-bearing capacity of the at least one of the containers by virtue of distributing the load on the upper surface of the vented closure;

supporting the stack for transportation, support being provided by the at least one container therein having its internal pressure maintained by the distributed load exerted upon the vented closure, whereby the internal gas pressure within the at least one container resists collapse of the container.

10. The method of claim 9, further comprising removing the filled case from the stack to remove the load on the filled case and allow the vented closure on the at least one container therein to return to the reference position.

11. The method of claim 9, wherein the step of supporting the stack includes support being provided by the case.

12. The method of claim 9, wherein all containers in a filled case have a vented closure.

13. A method of transporting cases holding containers filled with a gas evolving liquid, the method comprising:

filling each of a plurality of cases with at least one container having a vented closure, the vented closure having an upper surface, the vented closure having a reference position allowing gas to escape from the container without building up pressure therein when no load is placed on the vented closure, the vented closure having a sealing position preventing gas from escaping from the container when a load is placed on the vented closure and thereby maintaining internal pressure within the container, the vented closure being in the reference position in the absence of a load, the vented closure being in the sealing position in the presence of a load, such that the vented closure is responsive to a load irrespective an internal pressure of the at least one container;

stacking the cases in a stack so that each case comprising the stack, excepting the topmost case, has a load exerted upon a top wall of the case, the load provided by the weight of a portion of the stack thereon;

distributing the load exerted on the top wall of the case to the upper surface of the vented closure on the at least one container therein by placing the top surface flush and in contact with the top wall;

allowing the distributed load to move the vented closure from the reference position to the sealing position, whereby internal pressure provided by the vented closure in the sealing position prevents collapse of the container and provides support for the stack;

maintaining an internal pressure of the at least one of the containers to thereby increase a load-bearing capacity of the at least one of the containers by virtue of distributing the load on the upper surface of the vented closure; and transporting the stacked cases.

14. The method of claim 13, further comprising unstacking the cases to allow the vented closure on the at least one container in each case to return to the reference position.

15. The method of claim 13, wherein all containers within the case have a vented closure.

16. The method of claim 13, wherein the case is composed of corrugated cardboard.

* * * * *